US005740077A

United States Patent [19]

Reeves

[11] Patent Number: 5,740,077

[45] Date of Patent: Apr. 14, 1998

[54] GOLF ROUND DATA SYSTEM

[76] Inventor: G. George Reeves, 3324 Octavia St., Raleigh, N.C. 27606

[21] Appl. No.: 383,215

[22] Filed: Feb. 3, 1995

[51] Int. Cl.[6] ..... A63B 69/36; G06F 19/00

[52] U.S. Cl. ..... 364/561; 473/407; 364/411

[58] Field of Search ..... 364/561, 410, 364/411, 444, 460, 444.1; 340/323 R, 995, 990, 991, 993; 273/32 R, 32 H, 176 L, 213, 317.2, 108.2; 473/407, 131

[56] References Cited

U.S. PATENT DOCUMENTS

| | | | |
|---|---|---|---|
| 4,910,677 | 3/1990 | Remedio et al. | 364/410 |
| 5,097,416 | 3/1992 | Matthews | 364/410 |
| 5,319,548 | 6/1994 | Germain | 364/410 |
| 5,364,093 | 11/1994 | Huston et al. | 473/407 |
| 5,434,789 | 7/1995 | Fraker et al. | 364/411 X |
| 5,438,518 | 8/1995 | Bianco et al. | 364/411 X |

*Primary Examiner*—Emanuel T. Voeltz
*Assistant Examiner*—M. Kemper
*Attorney, Agent, or Firm*—Rhodes, Coats & Bennett, L.L.P.

[57] ABSTRACT

A golf round data system includes a portable data collection unit adapted to be carried by the user for displaying information to the user and for recording data concerning the golf round. Data concerning the layout of the golf course and the location of key golf course features is stored in the data collection unit internal memory. The data collection unit includes a receiver for receiving at least one external locating signal from which the user's current location on a course can be determined. A microcomputer in the data collection unit uses the external locating signal to determine a player's current location on the course and for calculating distances between the player's current location and a designated golf course feature, as the pin location. The distance calculated is displayed to the user. The data collection unit also includes input means to register each stroke taken by the user. The microcomputer is responsive to the input means to calculate the location on the course from which each stroke is taken. The location of each lie is stored in the data collection unit's memory and may be analyzed subsequently to derive player performance statistics. The recorded lies may be also be used to generate a plot of the golf course with each recorded lie.

30 Claims, 5 Drawing Sheets

RESORT HILLS COUNTRY CLUB
DAN E. GOLFER JUNE 20 1994

| HOLE | 1 | 2 | 3 | 4 | 5 | 6 | 7 | 8 | 9 | OUT |
|---|---|---|---|---|---|---|---|---|---|---|
| YARDS | 350 | 360 | 210 | 425 | 525 | 425 | 555 | 210 | 450 | 3,510 |
| PAR | 4 | 4 | 3 | 4 | 5 | 4 | 5 | 3 | 4 | 36 |
| SCORE | 5 | 5 | 3 | 6 | 5 | 5 | 6 | 4 | 4 | 43 |

| HOLE | 10 | 11 | 12 | 13 | 14 | 15 | 16 | 17 | 18 | IN |
|---|---|---|---|---|---|---|---|---|---|---|
| YARDS | 435 | 530 | 440 | 350 | 365 | 190 | 405 | 230 | 600 | 3,545 |
| PAR | 4 | 5 | 4 | 4 | 4 | 3 | 4 | 3 | 5 | 36 |
| SCORE | 4 | 7 | 5 | 4 | 4 | 3 | 5 | 4 | 6 | 42 |

X MARKS LOCATION OF STROKES

RESORT HILLS COUNTRY CLUB

DAN E. GOLFER JUNE 20 1994

| HOLE | 1 | 2 | 3 | 4 | 5 | 6 | 7 | 8 | 9 | OUT |
|---|---|---|---|---|---|---|---|---|---|---|
| YARDS | 350 | 360 | 210 | 425 | 525 | 425 | 555 | 210 | 450 | 3,510 |
| PAR | 4 | 4 | 3 | 4 | 5 | 4 | 5 | 3 | 4 | 36 |
| SCORE | 5 | 5 | 3 | 6 | 5 | 5 | 6 | 4 | 4 | 43 |

| HOLE | 10 | 11 | 12 | 13 | 14 | 15 | 16 | 17 | 18 | IN |
|---|---|---|---|---|---|---|---|---|---|---|
| YARDS | 435 | 530 | 440 | 350 | 365 | 190 | 405 | 230 | 600 | 3,545 |
| PAR | 4 | 5 | 4 | 4 | 4 | 3 | 4 | 3 | 5 | 36 |
| SCORE | 4 | 7 | 5 | 4 | 4 | 3 | 5 | 4 | 6 | 42 |

X MARKS LOCATION OF STROKES

RESORT HILLS COUNTRY CLUB

DAN E. GOLFER JUNE 20 1994

| HOLE | 1 | 2 | 3 | 4 | 5 | 6 | 7 | 8. | 9 | OUT |
|---|---|---|---|---|---|---|---|---|---|---|
| YARDS | 350 | 360 | 210 | 425 | 525 | 425 | 555 | 210 | 450 | 3,510 |
| PAR | 4 | 4 | 3 | 4 | 5 | 4 | 5 | 3 | 4 | 36 |
| SCORE | 5 | 5 | 3 | 6 | 5 | 5 | 6 | 4 | 4 | 43 |

| HOLE | 10 | 11 | 12 | 13 | 14 | 15 | 16 | 17 | 18 | IN |
|---|---|---|---|---|---|---|---|---|---|---|
| YARDS | 435 | 530 | 440 | 350 | 365 | 190 | 405 | 230 | 600 | 3,545 |
| PAR | 4 | 5 | 4 | 4 | 4 | 3 | 4 | 3 | 5 | 36 |
| SCORE | 4 | 7 | 5 | 4 | 4 | 3 | 5 | 4 | 6 | 42 |

X MARKS LOCATION OF STROKES

FIG. 5

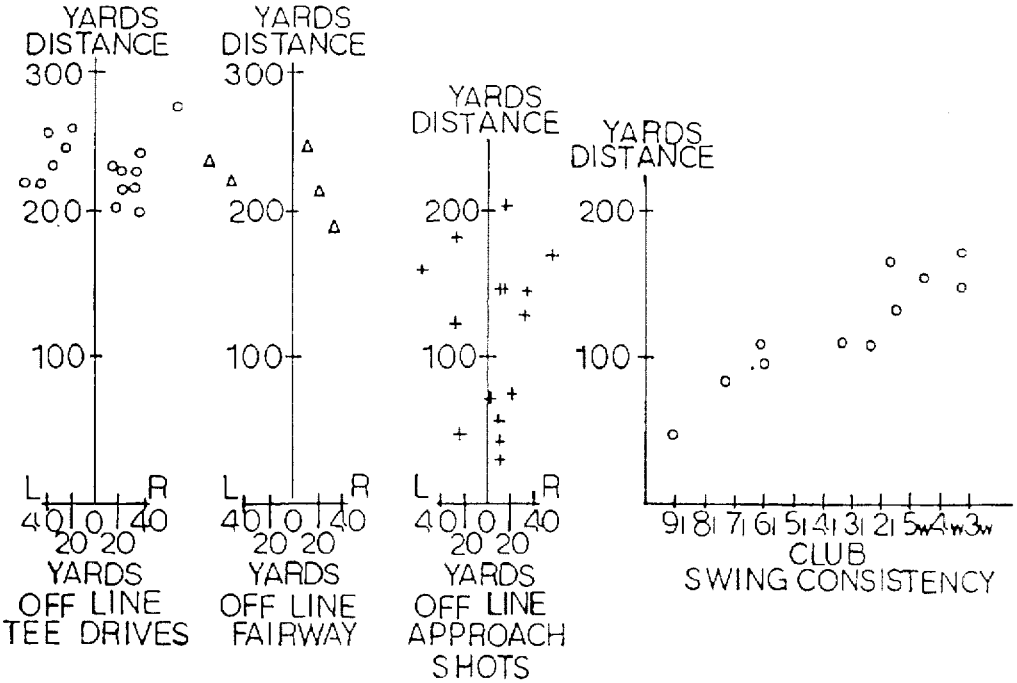

TEE DRIVE DISTANCE: Avg.= 224, Std. Deviation =17.5. Longest = 260
Player has strength to improve with better technique.

TEE DRIVE ACCURACY: Avg.=7.9 yds. to right with Std. deviation= 22.5.
Player has good acuracy to keep ball in fairway with slight tendency to push or slice.

FAIRWAY DRIVE DISTANCE: Avg.= 217, Std. Deviation = 19.2.

FAIRWAY DRIVE ACCURACY: Avg.= 18.0 yds. left, Std. Deviation = 25.7
Player has sufficient to keep ball in fairway with slight tendency to pull or hook.

SWING CONSISTENCY: Std. Deviation = 15.7 from 10 yds per club.

GOLF ROUND DATA SYSTEM

FIELD OF THE INVENTION

The present invention relates generally to golf aids, and more particularly to a golf round data system for collecting, storing, displaying, and analyzing information both during play and after play is completed.

BACKGROUND OF THE INVENTION

This invention is an improved system to provide golfers distance information conveniently, collect player performance data, produce analyses useful to golfers wishing to improve their play, aid course managers in controlling slow play, and produce commemorative certificates for players.

Golfers while playing a round need to know the distance remaining to the pin or hole location in order to select the club to be used for the next stroke. They typically try to maintain the same stroke mechanics for all distance shots taken and adjust the distance traveled, loft, and backspin of the ball by selecting the proper club. They also need some convenient way to retain information about the number of strokes used per hole in order to keep score. They would also like any device used as an aid to be convenient and easy to use without extensive training.

When not actually playing on a course golfers desire souvenirs of major events such as hole-in-one instances or successful reductions in their golfing handicap ratings. They also desire recognition for their golfing accomplishments in comparison to other players in the form of competitive rankings such as most improved play, longest drives in past month, most accurate drivers, cumulative number of holes parred or better, or fewest puts per round. They also generally wish to improve their play. To that end they desire game skill analysis to let them know where to efficiently apply their skill improvement efforts. They would find reliable information concerning their individual drive accuracy, swing consistency, drive length and number of puts after reaching the green very useful.

Golf course managers desire to please the players and encourage them to play more often. Managers also wish to encourage players to make use of revenue generating lessons and practice activities. The managers also want to keep the desired records and generate golfer desired outputs efficiently with minimum effort. Course managers also need to discourage slow play since one slow group on a course can impede all the players behind them and reduce the number of players who can be accommodated on a busy day.

In present practice golf scores are normally kept on handwritten score cards and distances are estimated by observing ball position relative to course landmarks whose distance from the pin is known only approximately. The handwritten score data is processed somewhat laboriously to compute handicap data. Devices and systems have been disclosed to improve the situation for golfers and course managers but they have not found wide acceptance.

Optical pin range finding devices similar to the common camera split screen range finder have been marketed as have optical radar devices which bounce a light beam from a retroreflector mounted on the hole pin( Golf Magazine, May 1994, pages 120–121). Both of these kinds of devices require the golfer to be able to see the pin and are thus not useful if the pin is over a rise or behind some vegetation from the ball position. Radio based devices which use a golfer operated transceiver at the ball position and a transponder on the pin have been disclosed by Jones et al (U.S. Pat. No. 4,136,394) and Olich (U.S. Pat. No. 5,298,904). These devices give only immediate range information to the player and do not provide or record enough data to generate scores or performance statistics. These distance to the pin devices do not determine the actual location of the ball lie or the direction in which it traveled and thus cannot be adapted to provide shot accuracy or distance statistics. These systems also require course managers to maintain active radio transponders at each of the 18 pins on a course in proper working order.

Radio location systems using three or more transmitting beacons and measurements of mobile receiver position relative to the beacons to determine distance between ball lie and known pin locations have been revealed by Cockerell (U.S. Pat. No. 4,698,781), Storms, Jr. et al (U.S. Pat. No. 4,703,444), and Wang et al (U.S. Pat. No. 5,056,106). These systems can conveniently give players distance information from their present location to obstacles on the course and the present target pin. They made no provision for collecting any useful round play performance data.

Devices to determine distances by counting golf cart wheel rotations have been disclosed by Alverez (U.S. Pat. No. 4,480,310) and Metcalf (U.S. Pat. No. 5,214,679). Metcalf included a score registering memory into which players could manually enter their scores on each hole to facilitate efficient score keeping. Both of these systems are unavailable to players who chose to walk the course for the exercise. They are also limited in usefulness when the cart cannot be driven up to the ball due to an obstacle or soft ground. Their accuracy degrades if tire pressure changes, wheels slip on soft ground, or the path from stroking point to the ball lie is not a straight line to the pin.

Cormie (U.S. Pat. No. 4,815,020) has disclosed a wheel rotation counting device for use with a hand-drawn wheeled golf bag caddy. To correct for drives which travel off a direct line from the tee to the pin the player must sight to the pin and ball lie and align pointers with the angles seen. The device did allow the player to accumulate information about distance achieved with each kind of club, but it had 24 buttons and two angle pointers to be manipulated at the proper time and sequence to obtain the desired results.

Remedio et al (U.S. Pat. No. 4,910,677) and Bonito et al (U.S. Pat. Nos. 5,095,430 and 5,127,044) have revealed systems to electronically retain and process data players enter manually about strokes used per hole to permit handicap computations by computer. The systems also permit players to manually enter approximate ball position to get an estimate of distance to the pin. These distance estimates are not easy to obtain since they depend upon the player accurately estimating ball location from visible landmarks on the course.

An inertial navigation system to determine golf course positions has been proposed by Barber (U.S. Pat. No. 5,245,537). The system is intended to yield distance information to the player and record golf round statistics electronically. The golfer is expected to align the inertial measurement system with course landmarks at intervals around the course and manipulate 28 buttons to get results. The system as described uses only two linear accelerometers and one angle accelerometer to determine its motion from the alignment points and thus can keep track only of travel in a single plane. Because it cannot keep track on tilts or vertical motion, it must be moved about the course without significantly tilting if the positions computed are to be accurate. Removing this severe restriction requires increasing the cost and complexity of the system to that of a conventional inertial navigation system such as those used in airplanes and missiles employing more sensors or a gyroscopically stabilized gimbaled platform.

Matthews (U.S. Pat. No. 5,086,390) has revealed a system for electronically keeping track of playing time per hole by tracking the positions of players as they traverse the course. Players carry radio transponders which receive location information from short range position transmitters at each hole. If golfers are progressing at a slow pace the transponder issues a warning and transmits a slow play signal to the management. Golfers get the warning even if their slowness is due to slow players in front of them. The system does tell course managers where to send course marshals to tell golfers to speed up; but it also requires them to maintain 18 separate location transmitters and provide labor to monitor the situation.

SUMMARY AND OBJECTS OF THE INVENTION

The present invention avoids the difficulties of the previous art, allows golfers to easily determine distances, and record round statistics. It also gives course managers easy ways to control slow play. Golfers take a portable radiolocation receiver, data collection and display unit with them as they play. The data collection unit can determine its location on the course, retains information concerning the current pin locations on the course, and can compute the distance from its present location to the pin of the hole being played. The data collection unit can display the present hole number, distance remaining to the pin, strokes used so far on the hole, club selected by the player for the next stroke, and time remaining to complete the hole and get to the next tee. The data collection unit also retains information about the round as it is played for later retrieval and analysis. Typical information of interest would be the player's identity, the number of strokes for each hole, the location from which each stroke is taken, the club selected, and time consumed to complete sections of the course. In normal operation the player would enter only the club to be used and press a button to register the fact that a stroke has been taken at the present location. Four button switches would permit the player to operate the unit and correct any errors made.

A second component of the invention is a data station which can transfer data to and from the data collection units, accept external data inputs from players or course management, and accumulate and maintain a player performance data base. The central station would also perform analyses of player performance and produce printed records, charts and plots for use by players and course management. Typical printed output would include: analyses of player strokes for consistency, length, and accuracy; a course map display showing the locations of strokes taken during the round; a warning if play was too slow; and handicap computation information. Commemorative certificates of significant events such as holes-in-one or handicap reductions would also be produced by the data station.

BRIEF DESCRIPTION OF THE DRAWINGS

FIG. 5 is an example of player statistics printed by a central data station after play.

DETAILED DESCRIPTION OF THE INVENTION

Figure 3:
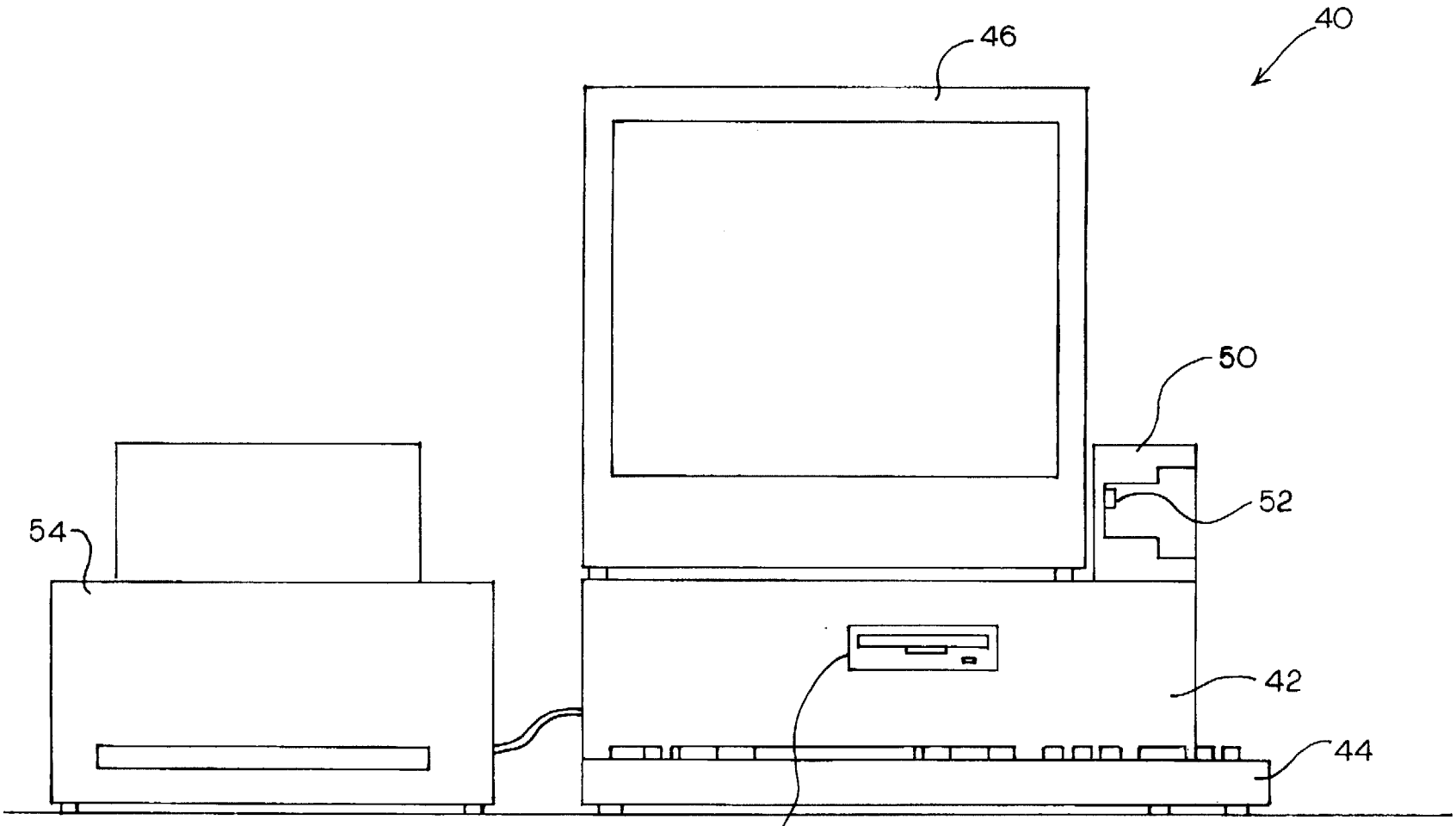
FIG. 3 is an elevation view of a central data station.

Referring now to the drawings, the golf data system 10 of the present invention is shown. The golf data system includes a portable data collection and display unit 20 (FIG. 1) and a central data station 40 (FIG. 3). The data collection unit 20 is adapted to be carried by the user to the location of each lie. The central data station 40 will typically be located at the club house and is used to initialize the data collection unit 20 prior to a round of golf, and to analyze the golf round data collected after the golf round is completed.

Figure 1:
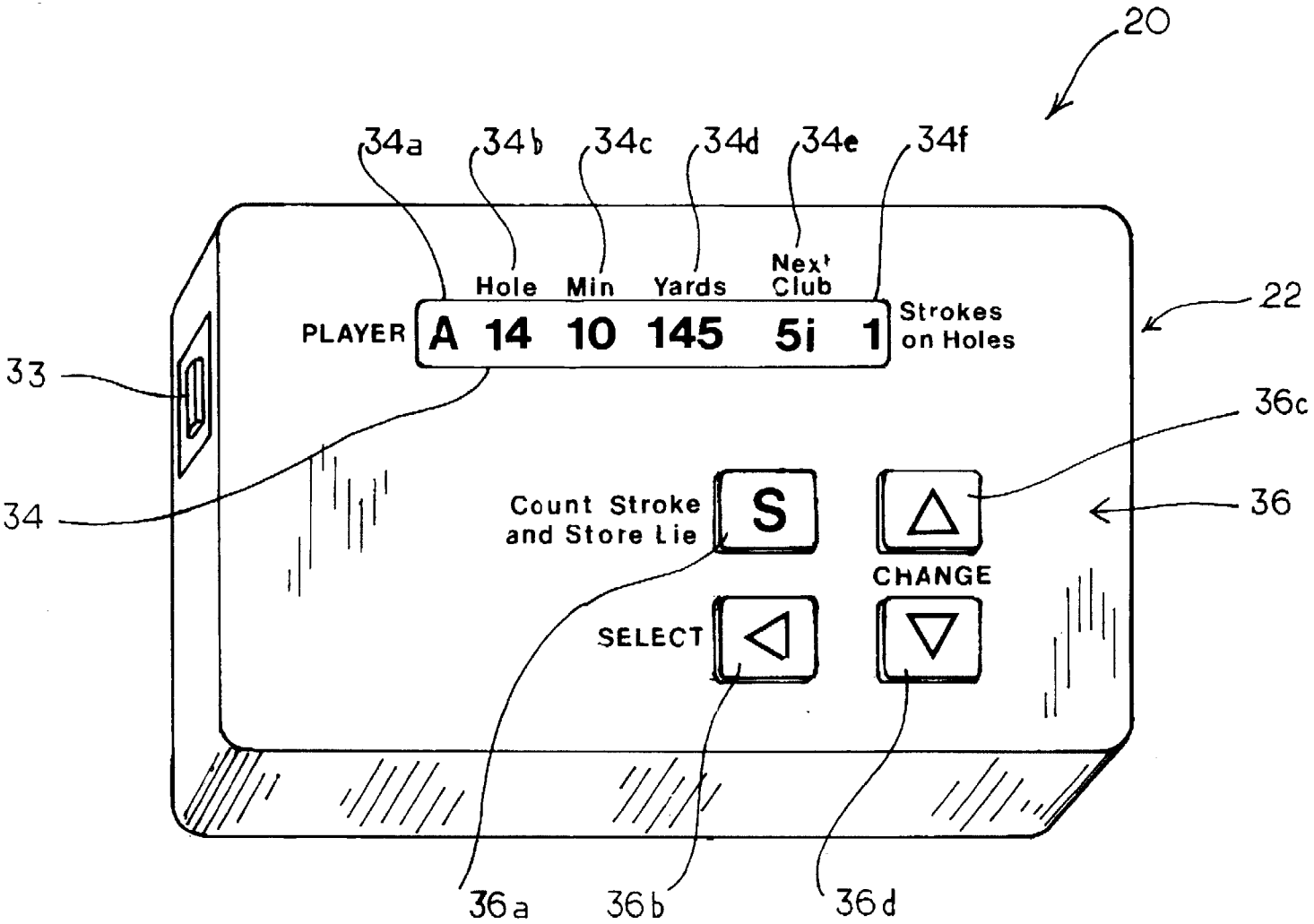
FIG. 1 is a perspective view of a portable data collection unit.
Figure 2:
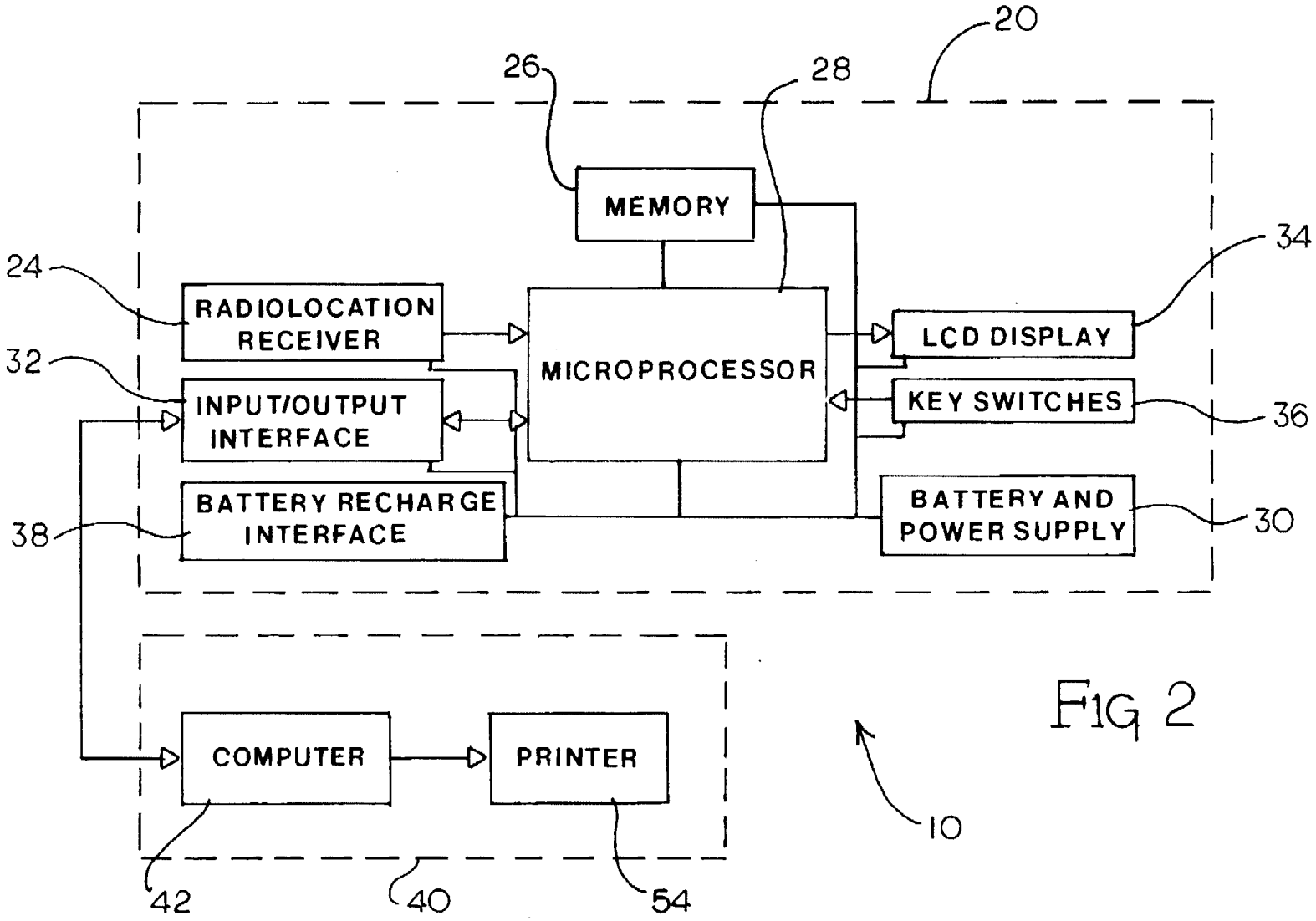
FIG. 2 is a schematic block diagram of the components of the golf data system.

FIG. 1 shows the data collection unit 20. The data collection unit 20 includes a case 22 made of a non-conducting material which permits the penetration of the radio waves used. The case 22 is also sealed so as to be water resistant and is sturdy enough to withstand the rigors of being carried about a golf course and occasionally dropped. Contained within the case 22 are a radiolocation receiver 24, data and program storage memory 26, a microcomputer 28 to perform the necessary calculations and control functions, one or more battery cells 30, a communications interface 32 permitting the unit to exchange data with the central data station 40, an LCD display 34, and input switches 36. An interface 38 is also provided for recharging the batteries 30. The communications interface 32 and recharge interface 38 are accessed via an access hole 33 on the data collection unit's housing 22. The access hole 33 should preferably include an elastomeric sealing plug to protect it against moisture.

The radiolocation receiver 24 can be any of several types of receivers which are well known to those skilled in the art. Since golfers want to know the distance to the pin to within the distance band of a single club which is about 10 yards, the radiolocation method chosen should be accurate to within +—3 yards. The well known global positioning system based on orbiting satellite beacons can be used in the differential mode to achieve the desired accuracy. A radiolocation system using local fixed beacons such as those of Storms et al, Wang et al, or Groth (U.S. Pat. No. 3,150,372) for example could be used if the beacons are kept close enough to the course to achieve the desired accuracy. Systems using only broadcast beacons such as that of Connelly (U.S. Pat. No. 4,555,707) and standard LORAN would not be suitable because the transmitters would in almost all situations be so far from the golf course that weather and time-of-day related changes in the propagation characteristics of the atmosphere would introduce excessive errors. Location errors due to long distance radio propagation can be corrected by adding a local transmitter to send differential error correction information in a manner similar to that used for differential mode global positioning systems. Whichever radiolocation scheme is used gives locations on the golf course in some orthogonal coordinate system to permit simple distance computations.

Many widely available microprocessors 28 can be used to perform the desired control and computation functions. The memory 26 included in the data collection unit must have enough available writable space at the beginning of play to record 5 bytes of data per lie. The data stored in a typical unit might include the coordinates of each ball lie, the club used on each stroke, the time at which each stroke is taken, and the identity of the player taking each stroke. This information is referred to hereinafter as the stroke data.

Four low skill players sharing a data collection unit 20 can accumulate as many as 600 ball lie positions in a round. Thus the available writable memory should be about 3000 bytes when play begins. The 5 bytes per lie position give 40 bits consisting of 24 bits to store coordinates of the ball about to be struck, 5 bits to designate the club to be used, 9 bits to record the time of the stroke, and 2 bits to record which player in the foursome who made the stroke. Time is kept in the form of minutes since the assigned starting tee time. An additional 100 bytes must be available when play begins to record start time, the times when each hole is completed, and the score for each player for each hole.

The power supply 30 must be sufficient to permit 12 hours of continuous play to allow a full day's use before battery changing or recharging. The display 34 is a conventional liquid crystal display easily visible in all outdoor lighting conditions having sufficient light to permit golf to be played. In the preferred embodiment, the display 34 is capable of displaying the player identification code 34*a*, the hole number 34*b*, the minutes remaining to the next tee 34*c*, the distance to a designated feature on the golf course 34*d*, the next club 34*e* and the cumulative strokes taken on the current hole 34*f*.

A keypad 36 having four individual keys 36*a*–36*d* is disposed in close proximity to the display 34. The stroke key 36*a* is used to register each lie on the course during a round of golf. The select key 36*b*, and the up and down keys, 36*c* and 36*d* respectively, are used to make changes in the display 34 as will be hereinafter described.

In operation the golfer or a representative of course management connects the data collection unit 20 to the central data station 40 to download set-up data into the data collection unit 20. The set-up data includes course layout data which is stored in the data collection unit's memory 26. The course layout data describes the physical layout of the golf course including the current pin locations on the course which are typically changed daily to even out green wear. For each of the players who are to share use of the data collection unit 20, the set-up data also includes any golfer-specific information such as name and/or identifying number and past performance data related to shot distance for each of the clubs that golfer customarily uses. If past performance data for a particular golfer is not available, then statistics for a player of average skill would be entered. The set-up data may also include course management information such as time remaining until tee time, whether or not the time per hole pacing feature (described below) is to be activated, time allotted for each hole (if the pacing feature is activated), intermission time allotted between holes 9 and 10, whether or not distances are to be displayed on the data collection 20 unit if it is within 20 yards of the pin, and whether or not the distance display is to be blanked completely for the entire round. Complete blanking of the distance display would be necessary for the remaining features of the system to be used in tournament play since the normal rules of golf prohibit the use of range finding devices in such play.

After the set-up data has been transferred to the data collection unit 20, the player display 34*a* shows an identifying initial or number for the first player entered into the data collection unit's memory 26, the hole number display 34*b* shows 0 because no hole has begun yet, the time display 34*c* shows the minutes remaining until tee time for the starting tee, the distance display 34*d* shows the distance to the starting tee, the club display 34*e* is blank as is the stroke count display 34*f*. If the time remaining until tee time exceeds 60 minutes then the time display 34*c* shows hours and minutes remaining separated by a colon. The distance display goes blank if there is insufficient received radio signal strength to produce an accurate measurement of position. This feature alerts the user to the need to reposition the data collection unit 20.

On heavy course usage days, which are typically weekend days with pleasant weather, slow play is a problem for course management. To combat slow play a pacing feature has been incorporated in this invention. When the pacing feature is active, the time display 34*c* on the data collection unit 20 shows the time remaining to play out the present hole and get to the next tee. For most players this gentle reminder would be sufficient to cause them to keep up their play pace adequately and not, for example, consume too much time hunting a hopelessly lost ball. However, the management can also use the time display 34*c* to make rules prohibiting slow play if that is necessary. There could be a busy course rule for example which states that a playing group loses its tee time on any hole if the fairway in front is clear and they have not left the tee before the next following group's tee time for that hole. The slow players would then have to stand aside and let the impeded following group play through and try to fit themselves into the following player stream or skip that hole and go to the next. Since the data collection unit 20 records the locations of all player groups on the course as they make strokes and the times at which they were there, it would be possible for management to identify habitual slow players and prohibit them from playing on busy days. The scheduled intermission feature between holes 9 and 10 recognizes the fact that courses are usually laid out to bring the players back so the clubhouse between holes 9 and 10. On hot days they are likely to appreciate a lengthened cooling break for refreshment. The time display 34*c* provides an easy and convenient way for players to take a break without impeding play. Management in scheduling the pacing feature simply adds the desired break time to the scheduled time to play hole number 9. The scheduled break between holes 9 and 10 also puts some slack in the playing schedule to allow slower players to get back on time.

The distance display 34*d* shows the distance from the present location to the next objective on the course. The radiolocation receiver 24 and microcomputer 28 determine the present location of the data collection unit 20 on the course. The location of the desired course objective has previously been stored in the data collection unit memory 26. The processor 28 uses this information in conjunction with its program instructions to compute the distance between the two points in a manner well known by those skilled in the art. In the interests of speeding play, course management may choose to activate the "close-to-the-pin" feature which causes the distance display to show "<20" when the data collection unit is less than 20 yards from the pin. This feature reduces distractions for players when they are close enough to the pin to clearly judge distances for themselves and are likely playing putting strokes.

The next club display 34*e* designates the numbered driver clubs as a number followed by a lower case letter d, the numbered iron clubs by a numeral followed by a lower case letter i, and the unnumbered clubs by two upper case letters such as PT for the putter, PW for the pitching wedge, and SW for the sand wedge.

When the time display 34*c* goes to zero, indicating that tee time for the starting tee has arrived, the hole number display 34*b* changes to the number of the starting tee. The distance display 34*d* shows the distance to the corresponding pin. It sometimes happens that players begin on hole 10 rather than 1 (for example, if they are going to play only 9 holes or there is course maintenance in progress on holes 1 through 9). The next club display 34*e* shows the club which the player identified by the player initial 34*a* would typically use if that player's previous performance data have been entered into the data collection unit's memory 26. In the absence of performance data for a particular player, the next club display 34e would show the club which would be used by an average player. The stroke display 34f shows a 0 because no strokes have yet been taken on the hole. At this point in the use cycle, the next club display 34e is blinking to indicate that it can be changed by the player by using the increase button 36c or the decrease button 36d on the data collection unit 20. The player can also use the select button 36b to select which display item blinks and can be changed by the increase or decrease buttons 36c and 36d. Each press of the select button 36b moves the focus (i.e., blinking) of the display 34 leftward among the items which the player can control. These are the next club display 34e, hole number display 34b, player identity display 34a, and stroke count display 34f. When the focus reaches the left most allowed position, the next press of the select button 36b moves the focus to the right most allowed position which in this embodiment is the stroke count 34f. One press of the select button 36b moves the focus to the hole number display 34b to permit it to be adjusted if necessary. A further press of the select button 36b moves the focus to the player initial display 34a and the remaining displays 34b–34f go blank. Instead the display 34 shows the name of the player corresponding to the player initial. At each following press of an increase or decrease button 36c and 36d, the player initial display 34a increments to another player initial and name if two or more players are sharing a data collection unit 20. A further press of the select button 36b returns the display 34 to normal. The next club display 34e blinks and can be changed at will by the player who is about to strike the ball from the tee. The player increases or decreases the club display 34e until it shows the club selected by the player for the stroke. Since the club display 34e already shows a club close to the appropriate one, the number of increases or decreases to make the display 34e match the club intended is small.

When the player is at the location of his first stroke he or she presses the stroke button 36a to register that a stroke has been taken. The club displayed by the club display 34e, the coordinate position on the course at which the stroke was taken, the time at which the stroke was taken, and the player taking the stroke is recorded in memory 26. The first stroke will usually be in a course tee area for the first hole to be played. These are typically fairly long to allow players of different abilities to play the course comfortably by using one of three tee locations usually designated in order of increasing distance from the pin as ladies, men's, and professional. For this reason it is necessary for the locations of tee strokes as well as the other strokes in a round to have their positions recorded.

After a stroke is recorded by pressing the stroke button 36a, the display 34 changes in one of two ways depending upon whether the data collection unit 20 is being used by a single or multiple players. If a single player is using it, then after a stroke is recorded the stroke display 34f increments by one and blinks to allow the player to easily use the increase button to register a penalty stroke if one should be called for by the results of the stroke just previously registered. The club display 34e shows the club just previously recorded for the stroke. In the event that the player pressed the stroke button 36a in error without actually taking a stroke or recorded a club not actually used, the stroke can be canceled by decreasing the stroke count by one using the decrease button 36d and a message scrolls from right to left across the display 34 in place of the numerical display. That message is "Canceling last stroke also erases its lie—press SELECT to proceed." The message repeats until it is acknowledged by the player pressing the select button 36b. Whether or not the previous stroke has been canceled, the display returns to normal. If the player using the data collection unit 20 singly does not press any buttons after registering a stroke and moves more than 10 yards from the lie recorded, the display reverts to normal with the approximate club to be used next blinking.

After play for a hole is complete and the data collection unit 20 leaves the vicinity of the pin and is transported to the tee for the next hole, the hole number display 34f advances to the next hole number to be played. Entry to the next tee area is easily detectable by the microcomputer 28 in the data collection unit 20 since the radiolocation system continually updates its present position data and the locations of pins and tee areas have been previously stored in the data collection unit memory 26. Thus a player using a data collection unit 20 by himself ordinarily would simply change the club display 34e and press the stroke button 36a as the round is played.

If multiple players are sharing a data collection unit 20, then after a stroke is registered by pressing stroke button 36a, the display 34 changes to show the stroke count increased by one and no display elements blinking for an interval of about 5 seconds. After the 5 second interval (during which the first player can see what has been registered) the player display 34a changes to that of another player and blinks while the remainder of the display shows that player's name. If the player designated is the next to take a stroke, then that player simply moves to his or her ball, presses the select button 36b twice to make the club display 34e blink, adjusts the club display to the club chosen using the increase or decrease buttons 36c and 36d, and registers a stroke by pressing the stroke button 36a. Thus, it is seen that two players can share a data collection unit 20 with nearly the same ease of operation as a single player. Four players sharing a data collection unit 20 would easily use the increase or decrease buttons 36c and 36d to select the correct initial and name before each stroke. Yet at any time the select button 36b and increase and decrease buttons 36c and 36d can be used to correct the displayed club, stroke count, and hole number for any of the players.

If no button is pressed within 15 minutes since the last button press, then the data collection unit 20 automatically records it's present position in memory to facilitate slow play detection.

If the writable memory capacity is used up before play is complete, the display 34 gives the message "memory full" whenever the stroke button 36a is pressed and the next club display stays blanked. The stroke count, time, hole display, and distance displays continue to function.

When the round play is complete, the data collection unit 20 is reconnected briefly to the data station 40 and the information collected during the round is transferred to the data station 40. At this time the internal electronics in the data collection unit 20 are set to a very low power standby mode with the receiver off, battery condition is assessed, and if necessary batteries are recharged at a separate recharging station (not shown). Charging is done with the opening pointed downward to permit any moisture which may have accumulated inside to drain. The warmth created inside the data collection unit case by battery charging further serves to drive out any accumulated moisture.

The data station 40 will typically consist of a general purpose, personal computer 42, an appropriate input device 44 (e.g., keyboard, mouse, trackball, etc.), display 46, floppy disk drive 48, and input/output ports for connecting to the data collection unit 20. The central data station 40 contains interface circuits which connect between the personal computer's serial communications port and an external docking station 50. The data collection unit 20 is inserted into the docking station 50. The docking station includes a connector 52 which mates with the access hole 33 on the housing 22 of the data collection unit 20. The mating connector 52 and the access hole 33 in the case of the data collection unit 20 are off center to prevent mating with the data collection unit 20 in a reversed orientation. The mating connector 52 is the printed circuit edge connector type to mate with contacts on the edge of a printed wiring board in the data collection unit 20. A printer 54 is one of any of the commonly available units which can print both text and graphical data and is connected to the personal computer through a printer output port.

The controlling program within the personal computer has eight major operating functions: inputting initial course layout, inputting daily course layout changes, storing past player round data, maintenance of course management parameters, inputting player identification, setting up the collection data collection units 20 prior to a round of play, retrieval of data from the data collection unit 20 data after a round of play, and producing end of round outputs for each player.

Initial course layout information is collected with a data collection unit 20 which has been reprogrammed to record course layout rather than round play data. On the reprogrammed data collection unit, the select button **36*b* switches between the hole number and a course feature descriptive word. The change buttons 36*c* and 36*d*** are used as in round play to change the hole number or feature description. Descriptive words which can be displayed are:

FAIRWAY CENT. indicating a position along the center of a fairway where a player might want his ball to land;

FAIRWY-SH.ROUGH indicating a boundary point between the fairway grass and the short rough grass which often borders it;

S.RGH.-T.RGH. indicating a boundary point between short rough grass and tall rough grass further from the fairway;

SAND TRAP EDGE indicating a boundary point at the edge of a sand trap;

WATER EDGE indicating a point at the edge of a water hazard;

HAZARD EDGE indicating a boundary point of a hazard such as a dry ditch which is neither sand or water;

OUT OF B.EDGE indicating a boundary point of an out-of-bounds region where play is not permitted;

FRINGE EDGE indicating a point on the outer edge of the short fringe grass typically surrounding a putting green;

GREEN EDGE indicating a boundary point at the edge of the putting green;

PIN LOCATION indicating the present location of the cup in the putting green;

TEE BOX EDGE indicating a boundary point at the edge of the tee off area;

LADIES TEE indicating the position of the tee closest to the pin;

MEN'S TEE indicating the position of the next nearest tee;

PRO TEE indicating the tee position furthest from the pin;

BUILDING indicating a point on the outer surface of a building such as a service structure, clubhouse, or pro shack; and PAVEMENT EDGE indicating a boundary point of a hard surface such as cart path, walkway, bridge, or parking lot.

To collect course layout data, one or more course employees walk over the course selecting features and pressing the select button **36*b* on their data collection units to record the positions of the features. The corners of rectangular features are recorded to permit the computer to draw the rectangle on the printed plot to be produced. Enough intermediate points on curved boundaries are recorded to permit the computer to reproduce them reasonably. After the positions are recorded they are entered into the computer using the external docking station 50** to transfer the data similar to the way it would after a round of play. The course layout section of the computer program then produces a graphical display of the course showing all the features recorded.

The daily course change input part of the computer program allows course workers to change pin locations and make any other changes they wish and record the new feature positions in a manner similar to that used to record the initial course layout. The graphical plot producing part of the program permits the previous layout to be edited to remove points such as old pin locations which are no longer valid and to add the new valid positions.

The part of the program which retains past player round data maintains a database for each player who has previously played the course using the system described here. The data files retain both the raw lie position and club data recorded by the data collection units and the computed analysis such as handicap, drive length and accuracy, shot strength, stroke consistency, stroke accuracy, average number of puts, and time to play a round.

The course management parameter maintenance section of the program allows management to set the correct time and date, select whether the "close-to-the-pin" feature is disabled, inhibit the distance display if the unit is to be used in competitive tournament play, turn the play pacing feature on or off, specify the starting hole number, and set the time allotted for each hole in the pacing feature.

The player initial data collection part of the program allows entry of player names to be used for a particular data collection unit 20, the identifying names and initials to be used by the data collection unit 20, and the starting tee time assigned to the group.

The data loading section of the program turns on the data collection unit 20 to its active mode and downloads to it the required set-up data prior to play. The set-up data loaded includes: player names and initials, player club distance if available, average player club distance if specific data is unavailable, date and time, starting hole number, distance display on/off, distance <20 yards on/off, pacing on/off, assigned tee time, present pin locations, and tee time for each hole on the course if the pacing feature is on.

After round play, the data retrieval section of the program retrieves data from the data collection 20 unit consisting of the unit identity; the players' identities; the date and time; and the location, club and time of each stroke taken by each player during the round. The round play data is appended to the data file maintained for each player. This section of the program also retrieves data concerning battery condition to determine whether or not they need recharging or replacing. After the data is retrieved the data collection unit 20 is set to a battery conserving standby condition.

Figure 4:
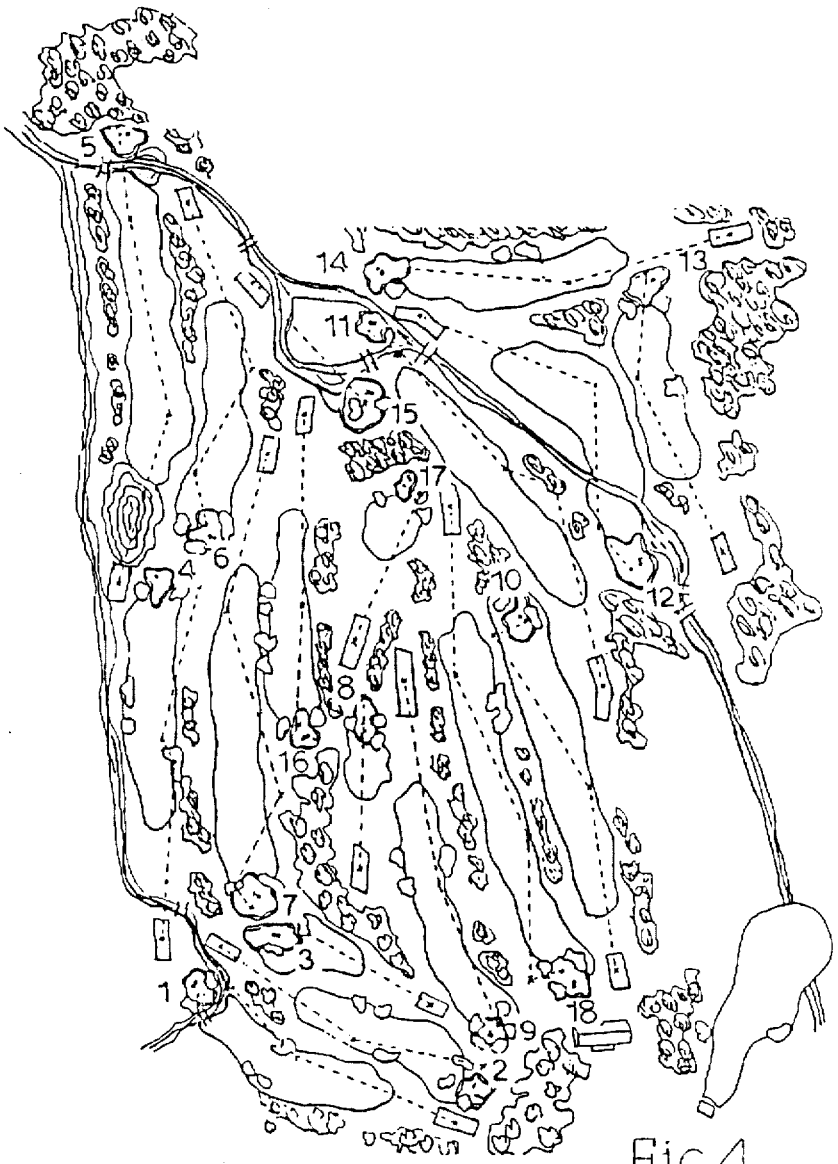
FIG. 4 is a souvenir map of a course and round.

The section of the program which produces end of round outputs processes data from the past and the last round. Outputs produced include a battery condition alarm to alert management if the battery needs to be recharged before the data collection unit can be used again. The alarm and a visual warning on the screen would be activated if the battery is failing to hold a sufficient charge and needs replacing. This section also updates the player database by adding the result of the round just completed to it. The output generating section also produces the printed outputs for the players including any commemorative certificates earned for unusual events such as a hole in one. Also produced are a plot of the course and all recorded lies as illustrated by FIG. 4 and a score card with round stroke summary as illustrated by FIG. 5. The end of round section of the program also has a portion which course management can use to examine player data files to rank players for recognition of their accomplishments.

What is claimed is:

1. A portable golf round data system for providing distance information to a player and for recording stroke data, comprising:

(a) a portable data collection unit adapted to be carried by said user including a receiver for receiving at least one external locating signal from which the user's current location on a golf course can be determined;

(b) course data storage in said data collection unit for storing data relating to the location of golf course features;

(c) a microcomputer in said data collection unit operatively connected to the receiver and to the data storage for determining a player's current location on said course from said external locating signal and for calculating distances between said current location and at least one of said golf course features retained in the said data storage;

(d) a display on said data collection unit connected to said processor and operative to display the distance between said current location and at least one selected golf course feature;

(e) stroke register means on said data collection unit to register each stroke taken by a user, said stroke register means being manually actuated by the user to record each stroke;

(f) said microcomputer being responsive to said stroke register means to maintain a count of the strokes taken during a round, wherein said count is incremented each time a stroke is registered;

(g) said microcomputer being further responsive to said stroke register means to calculate, based on said external locating signal, the location on said course from which each stroke is taken; and (h) stroke data storage in said data collection unit for storing the location on said course of each stroke taken until the end of play so that stroke locations can be subsequently retrieved at the end of a golf round.

2. The portable golf round data system of claim 1 wherein said input means includes means to input club data indicative of the club used for each stroke.

3. The portable golf round data system of claim 1 wherein said microcomputer is operative to maintain a count of the number of strokes taken for each hole and to output to said display the current number of strokes taken on a particular hole.

4. The portable golf round data system of claim 1 including past performance data storage for storing past performance data for a player.

5. The portable golf round data system of claim 4 wherein said microcomputer is operative to determine, based on said past performance data and the player's current location, a selected club and to output to said display the selected club.

6. The portable golf round data system of claim 1 wherein said microcomputer is operative to maintain a record of the current hole being played and to output to said display the current hole number.

7. The portable golf round data system of claim 1 wherein said microcomputer is operative to maintain a record of the current player where multiple players are using said golf round data system, and to output to said display identification data for the current player.

8. The portable golf round data system of claim 1 further including a clock for maintaining a record of the current time.

9. The portable round data system of claim 8 wherein said microcomputer is operative to record in said data storage the time at which each golf hole is completed.

10. The portable golf round data system of claim 9 further including pacing means for computing the time remaining to complete each hole based on said pacing data and outputting to said display said remaining time.

11. The portable golf round data system of claim 10 further including means to disable said pacing means.

12. The portable golf round data system of claim 1 further including at least one central data station including means for downloading stroke data from said portable data collection unit; processing means for calculating player performance data based on said stroke data and generating performance reports; and a printer for printing said performance reports.

13. The portable golf round data storage system of claim 12 wherein said central data station further includes means for generating a golf course plot with the location of all recorded strokes.

14. The portable golf round data system of claim 12 wherein said central data station further includes means for printing commemorative certificates for specified events.

15. The portable golf round data system of claim 12 including data storage for storing player identity data and player performance data.

16. The portable golf round data system of claim 1 further including means to disable the display of distances on said display.

17. The portable golf round data system of claim 16 further including means to disable the display of distances within a predetermined distance of a hole.

18. The portable golf round data system of claim 4 further including means to disable the display of club data.

19. A golf round data system for recording stroke data, comprising:

(a) a portable data collection unit adapted to be carried by said user including a receiver for receiving one or more locating signals from which the user's current location on a golf course can be determined;

(b) stroke register means on said data collection unit to register each stroke taken by a user, said stroke register means being manually actuated by the user to record each stroke;

(c) counting means responsive to said stroke register means for maintaining a count of the strokes taken during a round, wherein said counting means is incremented each time a stroke is registered; and (d) stroke data storage in said data collection unit for storing stroke location data for each stroke taken until the end of play so that stroke locations can be subsequently retrieved at the end of a golf round, said location data being derived from said external locating signals.

20. The portable golf round data system of claim 19 wherein said input means includes means to input club data indicative of the club used for each stroke.

21. The portable golf round data system of claim 19 further including at least one central data station including means for transferring stroke data from said portable data collection units, processing means for calculating player performance data based on said stroke data and generating performance reports, and a printer for printing said performance reports.

22. The portable golf round data storage system of claim 21 wherein said central data station further includes means for generating a golf course plot with the location of all recorded strokes.

23. The portable golf round data system of claim 21 wherein said central data station further includes means for printing commemorative certificates for specified events.

24. A golf round data method for collecting golf round data using a portable data collection unit including data storage and a radiolocation device for determining a player's current location from one or more external locating signals, said golf round data method comprising:

(a) registering each stroke taken in said data collection unit;

(b) storing stroke data in said data storage corresponding to the location of each stroke taken when a stroke is registered;

(c) transferring said data to a processing means; and (d) analyzing said data with said processing means to determine the location of each recorded lie on said golf course.

25. The golf round data method of claim 24 wherein said processing means is located on said data collection unit.

26. The golf round data method of claim 25 further including the step of inputting into said portable data collection unit club data indicative of the club used for each stroke taken, and storing said club data in said data storage.

27. The golf round data method of claim 25 wherein said stroke data is transferred to a central data station having a data processing means.

28. The golf round data method of claim 27 further including the step of computing in said data processing means player performance data based upon said golf stroke data.

29. The golf round data method of claim 28 further including the step of printing said player performance data.

30. The golf round data system of claim 27 further including the step of generating a plot of said golf course with the location of each recorded golf stroke on said plot.

* * * * *